US008581130B2

(12) United States Patent
Jhuang et al.

(10) Patent No.: US 8,581,130 B2
(45) Date of Patent: Nov. 12, 2013

(54) KEY STRUCTURE WITH SCISSORS-TYPE CONNECTING MEMBER

(75) Inventors: Chuang-Shu Jhuang, Taipei (TW); Tzu-Yi Liao, Taipei (TW)

(73) Assignee: Primax Electronics Ltd., Taipei (TW)

( * ) Notice: Subject to any disclaimer, the term of this patent is extended or adjusted under 35 U.S.C. 154(b) by 230 days.

(21) Appl. No.: 13/156,786

(22) Filed: Jun. 9, 2011

(65) Prior Publication Data

US 2012/0267226 A1 Oct. 25, 2012

(30) Foreign Application Priority Data

Apr. 22, 2011 (TW) ..... 100114027 A

(51) Int. Cl.
*H01H 13/70* (2006.01)

(52) U.S. Cl.
USPC ..... 200/344; 200/345; 400/490; 400/491

(58) Field of Classification Search
USPC ..... 200/344, 345; 400/490, 491
See application file for complete search history.

(56) References Cited

U.S. PATENT DOCUMENTS 7,893,376 B2 * 2/2011 Chen ..... 200/344

* cited by examiner

*Primary Examiner* — Renee S Luebke
*Assistant Examiner* — Ahmed Saeed
(74) *Attorney, Agent, or Firm* — Kirton McConkie; Evan R. Witt

(57) ABSTRACT

A key structure with a scissors-type connecting member is provided. The scissors-type connecting member includes a first frame and a second frame. The first frame includes a rotating shaft and a pushing bulge. After the first frame is stacked on the second frame, if the second frame may be pushed by the pushing bulge, the second frame is subject to deformation to facilitate combining the first frame and the second frame together.

9 Claims, 7 Drawing Sheets

KEY STRUCTURE WITH SCISSORS-TYPE CONNECTING MEMBER

FIELD OF THE INVENTION

The present invention relates to a key structure, and more particularly to a key structure of a keyboard device.

BACKGROUND OF THE INVENTION

Generally, the common input device of a computer includes for example a mouse device, a keyboard device, a trackball device, and the like. Via the keyboard device, the user may directly input characters and commands into the computer. As a consequence, most users and most manufacturers of the input devices pay much attention to the development of the keyboard devices.

Hereinafter, the configurations and the functions of a conventional keyboard device will be illustrated with reference to FIG. 1. FIG. 1 is a schematic view illustrating the outward appearance of a conventional keyboard device. As shown in FIG. 1, plural keys 10 are installed on the surface of the conventional keyboard device 1. These keys 10 are classified into some types, e.g. ordinary keys, numeric keys and function keys. When one or more keys 10 are depressed by the user's fingers, a corresponding signal is issued to the computer, and thus the computer executes a function corresponding to the depressed key or keys. For example, when an ordinary key is depressed, a corresponding English letter or symbol is inputted into the computer. When a numeric key is depressed, a corresponding number is inputted into the computer. In addition, the function keys (F1~F12) can be programmed to cause corresponding application programs to provide certain functions.

Hereinafter, the components of a key structure of the conventional keyboard device will be illustrated with reference to FIG. 2. FIG. 2 is a schematic exploded view illustrating a key structure of a conventional keyboard device. As shown in FIG. 2, the key structure 2 comprises a keycap 21, a scissors-type connecting member 22, an elastic element 23, a membrane switch circuit 24 and a base plate 25. The keycap 21 may be touched and depressed by the user. The keycap 21 is connected with the scissors-type connecting member 22. The scissors-type connecting member 22 is arranged between the keycap 21 and the base plate 25. In addition, the scissors-type connecting member 22 is connected with the keycap 21 and the base plate 25. The scissors-type connecting member 22 comprises an inner frame 221 and an outer frame 222. The inner frame 221 has an inner frame shaft 2211. Corresponding to the inner frame shaft 2211, an outer frame hole 2221 is formed in the outer frame 222. By penetrating the inner frame shaft 2211 through the outer frame hole 2221, the inner frame 221 and the outer frame 222 are connected with each other, and the inner frame 221 may be swung with respect to the outer frame 222. The membrane switch circuit 24 is arranged on the base plate 25. The elastic element 23 is arranged between the keycap 21 and the membrane switch circuit 24. When the keycap 21 is depressed, the elastic element 23 is deformed downwardly to trigger the membrane switch circuit 24, so that the membrane switch circuit 24 generates an electronic signal.

In a case that the key structure 2 is not depressed, the keycap 21 of the key structure 2 is located at a first height (not shown). Whereas, when the key structure 2 is depressed, a depressing force is exerted on the keycap 21, and the elastic element 23 is compressed in response to the depressing force. As the keycap 21 is depressed, the inner frame 221 and the outer frame 222 of the scissors-type connecting member 22 are swung, so that the inner frame 221 and the outer frame 222 are parallel with each other. At the same time, the elastic element 23 is deformed downwardly to trigger the membrane switch circuit 24, so that the membrane switch circuit 24 generates an electronic signal. In addition, the keycap 21 of the key structure 2 is lowered from the first height to a second height (not shown). The difference between the first height and the second height indicates the travel distance of the key structure 2.

In a case that the depressing force exerted on the keycap 21 is eliminated, the keycap 21 will be moved upwardly is response to the restoring force of the elastic element 23. As the keycap 21 is moved upwardly, the inner frame 221 and the outer frame 222 are transmitted by the keycap 21 to rotate. As such, the keycap 21 is returned to its original position where the keycap 21 has not been depressed (i.e. at the first height).

In designing the scissors-type connecting member 22, the keycap 21 needs to be returned to its original position (i.e. at the first height) after the depressing force exerted on the keycap 21 is eliminated. Generally, the elastic element 23 provides the restoring force to push the keycap 21 back to its original position. Moreover, the inner frame 221 and the outer frame 222 need to cooperate with each other to precisely control the upward moving action of the keycap 21 in the vertical direction. In other words, the scissors-type connecting member 22 is a very important factor that influences the quality and the use life of the key structure 2.

Moreover, for combining the inner frame 221 with the outer frame 222, the user needs to prop open the outer frame 222 to widen the distance between the two outer frame holes 2221, which are formed in bilateral sides of the outer frame 222. As such, the inner frame shaft 2211 can be successfully inserted into corresponding outer frame holes 2221 to combine the inner frame 221 and the outer frame 222 together. The procedure of propping-open the outer frame 222 increases the assembling time of the key structure 2 and is detrimental to the throughput of the keyboard device. Moreover, since the outer frame 222 has the outer frame holes 2221, the whole structure of the outer frame 222 becomes weak and is easily damaged. In other words, the scissors-type connecting member 22 is not suitable for slimness of the key structure 2.

SUMMARY OF THE INVENTION

The present invention provides a key structure with a scissors-type connecting member, which is easily assembled.

The present invention also provides a key structure with a scissors-type connecting member, which is not easily damaged.

In accordance with an aspect of the present invention, there is provided a key structure. The key structure includes a base plate, a keycap and a scissors-type connecting member. The scissors-type connecting member is arranged between the base plate and the keycap for connecting the base plate with the keycap, so that the keycap is moved upwardly or upwardly with respect to the base plate. The scissors-type connecting member includes a first frame and a second frame. The first frame includes a rotating shaft and a pushing bulge. The rotating shaft is disposed on a first sidewall of the first frame. The pushing bulge is disposed on the first sidewall of the first frame and arranged at a first side of the rotating shaft. Moreover, the pushing bulge is located at a level lower than the rotating shaft. The second frame is connected with the first frame and permitted to be swung with respect to the first frame. The second frame includes a first receiving recess and a second receiving recess. The first receiving recess is formed in a second sidewall of the second frame for accommodating the rotating shaft. The second receiving recess is formed in the second sidewall of the second frame and arranged at a first side of the first receiving recess for accommodating the pushing bulge.

In an embodiment, the second frame further includes a marking structure and a first guiding surface. The marking structure is disposed over the second receiving recess and exposed to a top surface of the second frame for marking a location of the second receiving recess. The first guiding surface is disposed over the first receiving recess and arranged between the top surface of the second frame and the second sidewall. After the first frame is stacked on the second frame and the pushing bulge is contacted with the top surface of the second frame, the rotating shaft is guided by the first guiding surface to pass through the top surface of the second frame and the second sidewall so as to be accommodated within the first receiving recess.

In an embodiment, the rotating shaft includes a first slant surface and a first slant surface. When the second sidewall of the second frame is pushed by the pushing bulge, the first guiding surface is contacted with and pushed by the first slant surface, so that the rotating shaft is guided to be introduced into the first receiving recess. The second slant surface is disposed over the first slant surface to be contacted with the first receiving recess, thereby facilitating the rotating shaft to be introduced into the first receiving recess.

In an embodiment, the marking structure further includes a second guiding surface, which is arranged between a top surface of the marking structure and the second sidewall. After the first frame is stacked on the second frame and the pushing bulge is contacted with the marking structure, the pushing bulge is guided by the second guiding surface to pass through the marking structure and the second sidewall so as to be accommodated within the second receiving recess.

In an embodiment, the pushing bulge includes a third slant surface, which is arranged between a sidewall of the pushing bulge and a bottom surface of the pushing bulge. When the second guiding surface is contacted with and pushed by the third slant surface, the second frame is subject to deformation to facilitate introducing the rotating shaft and the pushing bulge into the first receiving recess and the second receiving recess, respectively.

In an embodiment, the first frame further includes a position-limiting bulge, which is disposed on the first sidewall of the first frame and arranged at a second side of the rotating shaft.

In an embodiment, the second frame further includes a notch, which is formed in the second sidewall of the second frame, exposed to a top surface of the second frame and arranged at a second side of the first receiving recess. The position-limiting bulge is movable within the notch. Moreover, the notch has a stopping part for stopping the position-limiting bulge and limiting a movable range of the position-limiting bulge within the notch.

In an embodiment, the key structure further includes a membrane switch circuit and an elastic element. The membrane switch circuit is disposed on the base plate. When the membrane switch circuit is triggered, the membrane switch circuit generates a key signal. The elastic element is disposed on the membrane switch circuit. A lower portion of the elastic element is contacted with the membrane switch circuit, wherein the elastic element is penetrated through the scissors-type connecting member and an upper portion of the elastic element is contacted with the keycap. When the elastic element is pushed by the keycap, the membrane switch circuit is triggered by the elastic element. Whereas, when a depressing force exerted on the keycap is eliminated, an elastic force provided by the elastic element is exerted on the keycap.

In an embodiment, the first frame is an inner frame, the second frame is an outer frame, the first frame is installed within the second frame, and the first frame has a central hollow portion.

In an embodiment, the first frame is an outer frame, the second frame is an inner frame, the second frame is installed within the first frame, and the second frame has a central hollow portion.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
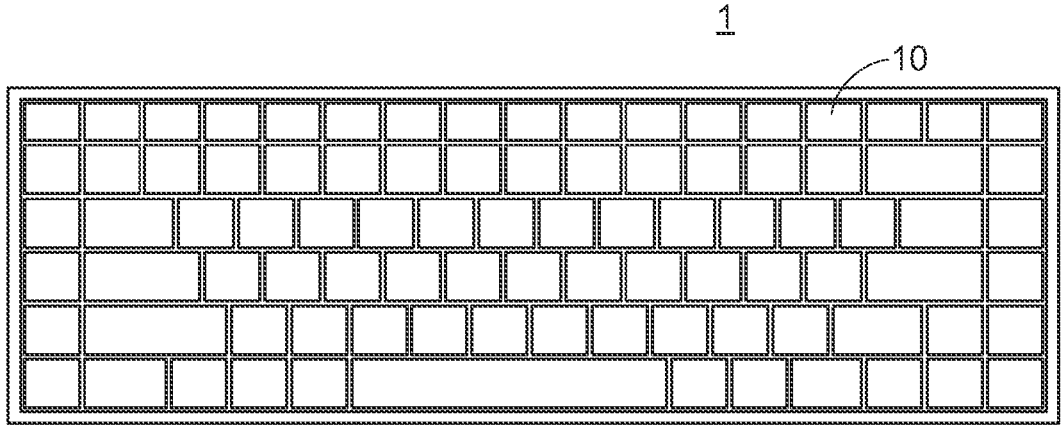
FIG. 1 PRIOR ART
FIG. 1 is a schematic view illustrating the outward appearance of a conventional keyboard device.
Figure 2:
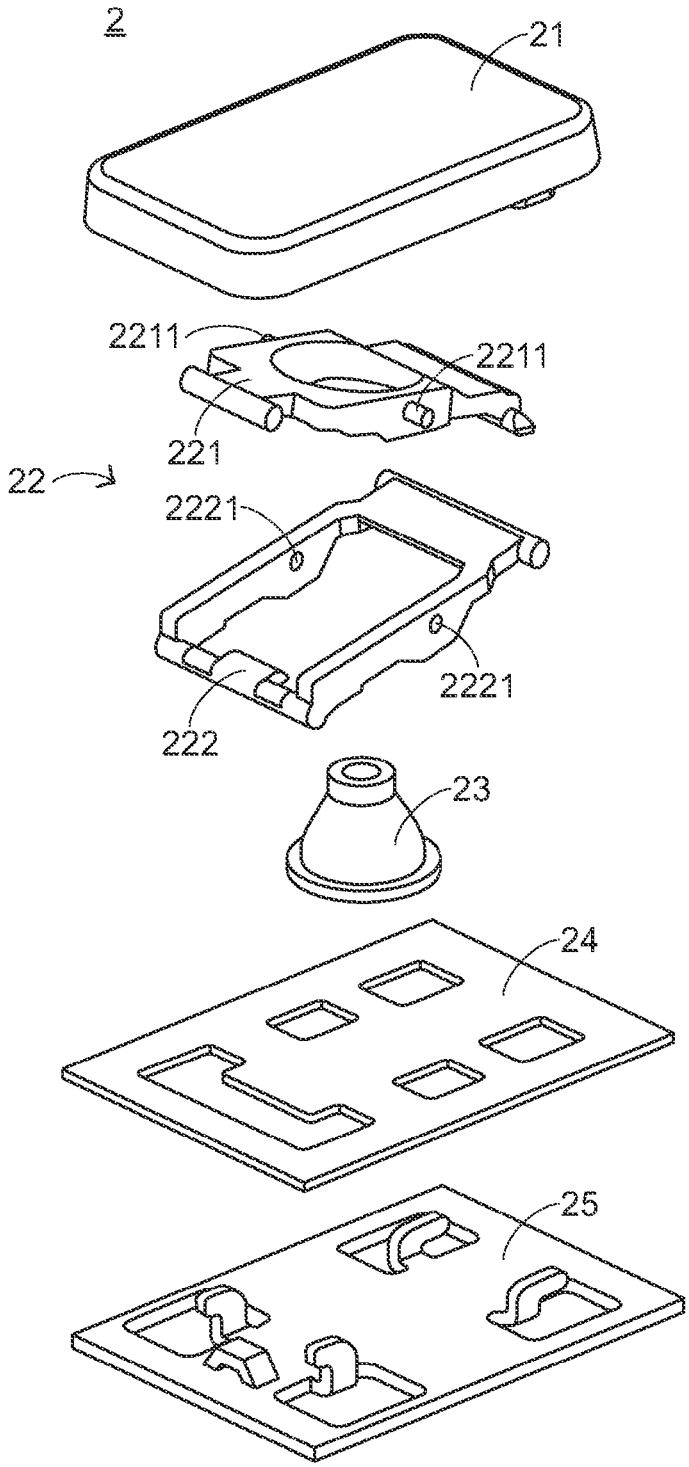
FIG.2 PRIOR ART
FIG. 2 is a schematic exploded view illustrating a key structure of a conventional keyboard device.
Figure 3:
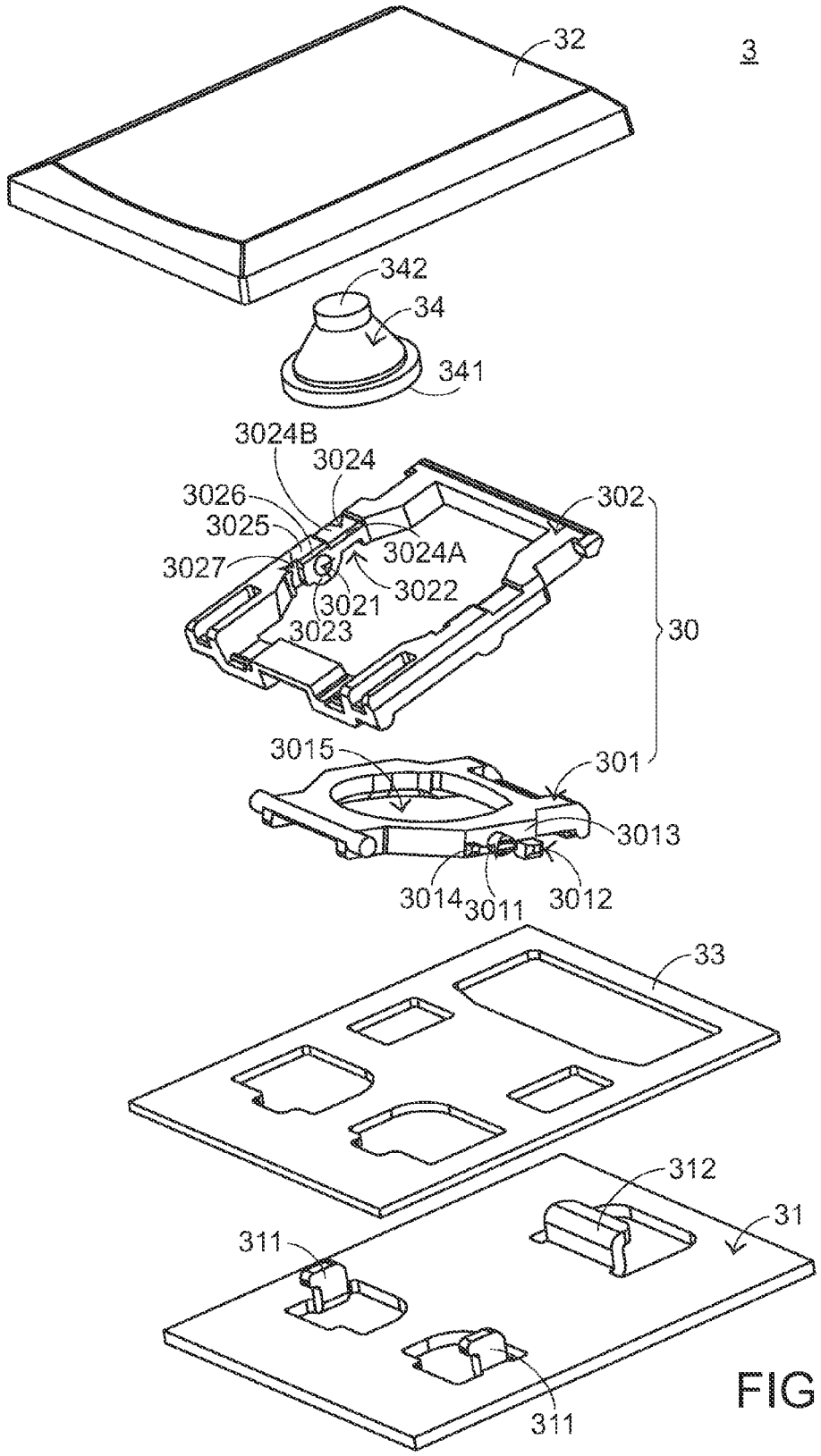
FIG. 3 is a schematic exploded view illustrating a key structure with a scissors-type connecting member according to a first embodiment of the present invention.

For obviating the drawbacks encountered from the prior art, the present invention provides a key structure with a scissors-type connecting member. FIG. 3 is a schematic exploded view illustrating a key structure with a scissors-type connecting member according to a first embodiment of the present invention. As shown in FIG. 3, the key structure 3 comprises a scissors-type connecting member 30, a base plate 31, a keycap 32, a membrane switch circuit 33 and an elastic element 34. The scissors-type connecting member 30 is arranged between the keycap 32 and the membrane switch circuit 33. The scissors-type connecting member 30 comprises a first frame 301 and a second frame 302. The first frame 301 and the second frame 302 are connected with each other. In this embodiment, the first frame 301 is an inner frame, and the second frame 302 is an outer frame. The first frame 301 of the scissors-type connecting member 30 comprises a rotating shaft 3011, a pushing bulge 3012, a position-limiting bulge 3014 and a central hollow portion 3015. The second frame 302 of the scissors-type connecting member 30 comprises a first receiving recess 3021, a second receiving recess 3022, a marking structure 3024, a first guiding surface 3026 and a notch 3027.

Please refer to FIG. 3 again. The membrane switch circuit 33 is arranged between the base plate 31 and the elastic element 34. When the membrane switch circuit 33 is triggered, the membrane switch circuit 33 issues a key signal. The elastic element 34 is arranged between the keycap 32 and the membrane switch circuit 33. In addition, the elastic element 34 comprises an upper portion 341 and a lower portion 342. For combining the components of the key structure 3 together, the elastic element 34 is penetrated through the hollow portion 3015 of the first frame 301, the upper portion 341 of the elastic element 34 is contacted with the keycap 32, and the lower portion 342 of the elastic element 34 is contacted with the membrane switch circuit 33. The base plate 31 is disposed under the membrane switch 33. In addition, the base plate 31 comprises a first hook 311 and a second hook 312. The first hook 311 is arranged at a first side of the base plate 31 and connected with a first end of the second frame 302. The second hook 312 is arranged at a second side of the base plate 31 and connected with a second end of the first frame 301. For connecting the keycap 32 with the scissors-type connecting member 30, the keycap 32 further comprises hooks similar to the first hook 311 and the second hook 312 of the base plate 31. Via these hooks, the first end of the first end 301 and the second end of the second 302 can be connected with the keycap 32.

Figure 4:
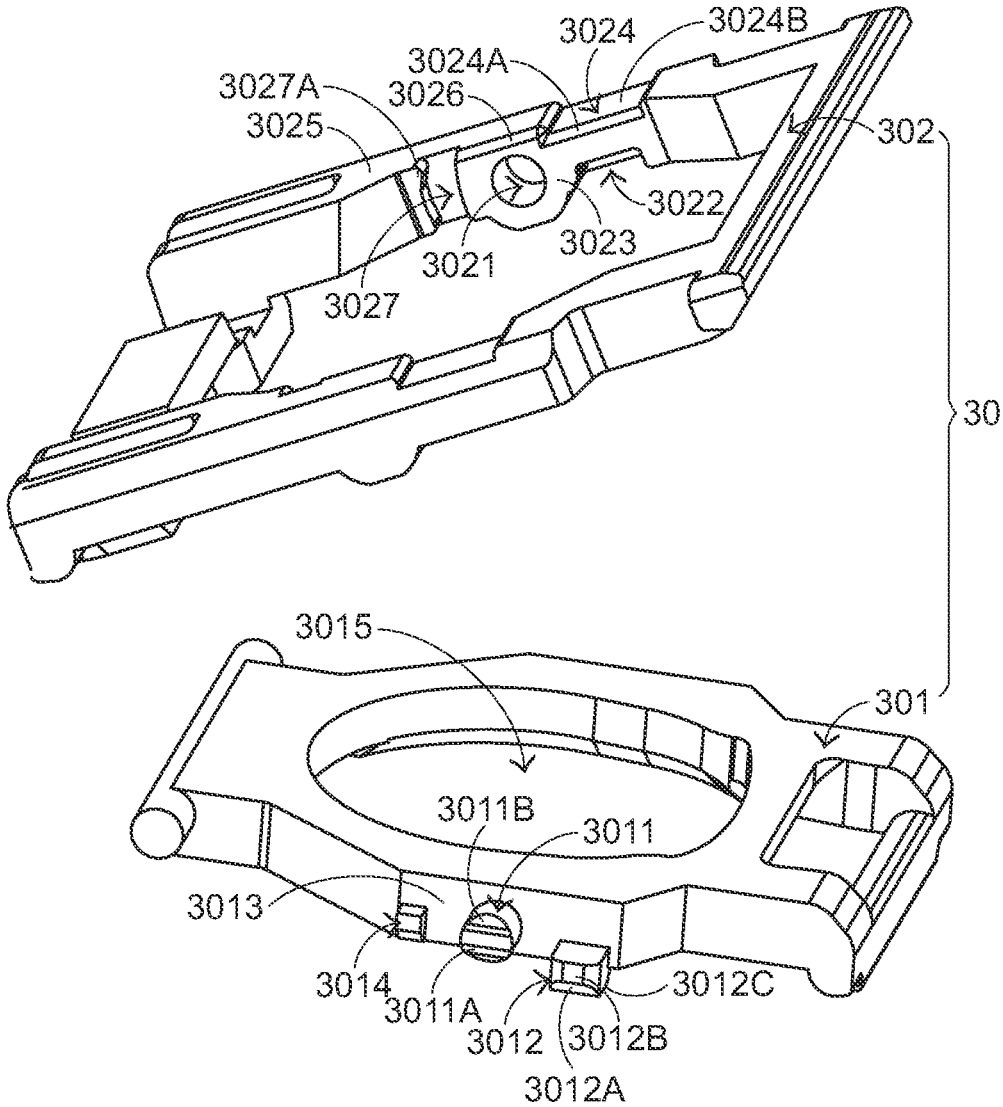
FIG. 4 schematically illustrates the first frame and the second frame of the scissors-type connecting member of the key structure according to the first embodiment of the present invention.

Hereinafter, the detailed configurations of the scissors-type connecting member 30 will be illustrated with reference to FIG. 4. FIG. 4 schematically illustrates the first frame and the second frame of the scissors-type connecting member of the key structure according to the first embodiment of the present invention. In the first frame 301, the rotating shaft 3011 is disposed on a first sidewall 3013 of the first frame 301. Moreover, the rotating shaft 3011 has a first slant surface 3011A and a second slant surface 3011B. The pushing bulge 3012 is disposed on the first sidewall 3013 of the first frame 301 and arranged at a first side of the rotating shaft 3011. The location of the pushing bulge 3012 is at a level lower than the rotating shaft 3011. The pushing bulge 3012 comprises a third slant surface 3012A. The third slant surface 3012A is arranged between a sidewall 3012B of the pushing bulge 3012 and a bottom surface 3012C of the pushing bulge 3012. The position-limiting bulge 3014 is disposed on the first sidewall 3013 of the first frame 301 and arranged at a second side of the rotating shaft 3011.

In the second frame 302, the first receiving recess 3021 is formed in a second sidewall 3023 of the second frame 302 for accommodating the rotating shaft 3011. The second receiving recess 3022 is formed in the second sidewall 3023 of the second frame 302 and arranged at a first side of the first receiving recess 3021 for accommodating the pushing bulge 3012. The marking structure 3024 is disposed over the second receiving recess 3022 and exposed to a top surface 3025 of the second frame 302 for marking the location of the second receiving recess 3022. The marking structure 3024 further comprises a second guiding surface 3024A. The second guiding surface 3024A is arranged between a top surface 3024B of the marking structure 3024 and the second sidewall 3023. In this embodiment, the marking structure 3024 is a concave structure. That is, the location of the top surface 3024B of the marking structure 3024 is at a level lower than the top surface 3025 of the second frame 302. The first guiding surface 3026 is disposed over the first receiving recess 3021 and arranged between the top surface 3025 of the second frame 302 and the second sidewall 3023. The notch 3027 is formed in the second sidewall 3023 and exposed to the top surface 3025 of the second frame 302. Moreover, the notch 3027 is arranged at a second side of the first receiving recess 3021 for accommodating the position-limiting bulge 3014. The position-limiting bulge 3014 is movable within the notch 3027. The notch 3027 has a stopping part 3027A for stopping the position-limiting bulge 3014 and limiting the movable range of the position-limiting bulge 3014 within the notch 3027.

Figure 5A:
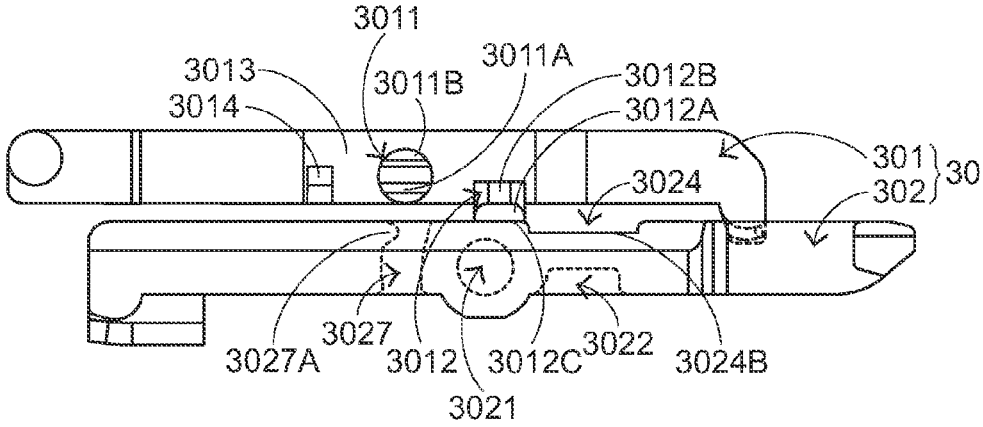
FIGS. 5A and 5B are schematic side views illustrating the first frame and the second frame of the key structure in a folded state according to the first embodiment of the present invention.
Figure 5B:
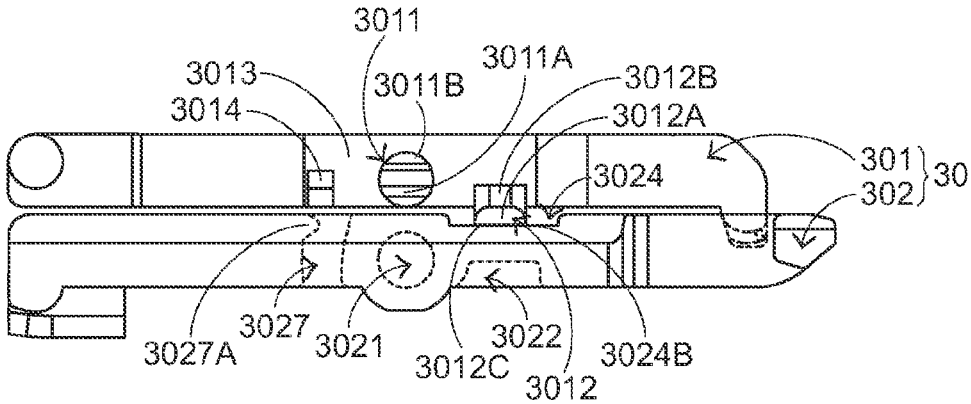

Hereinafter, a process of combining the first frame 301 with the second frame 302 will be illustrated with reference to FIGS. 4, 5A and 5B. FIGS. 5A and 5B are schematic side views illustrating the first frame and the second frame of the key structure in a folded state according to the first embodiment of the present invention. For combining the first frame 301 and the second frame 302 together to assemble the scissors-type connecting member 30, the first frame 301 is firstly stacked on the second frame 302. Since the location of the pushing bulge 3012 is lower than the location of the rotating shaft 3011, after the first frame 301 is stacked on the second frame 302, the pushing bulge 3012 is contacted with the top surface 3025 of the second frame 302 (see FIG. 5A). Then, the first frame 301 is moved relative to the second frame 302. Since the marking structure 3024 is a concave structure, when the pushing bulge 3012 is moved to the location of the marking structure 3024, the pushing bulge 3012 is descended to the top surface 3024B of the marking structure 3024 to indicate that the pushing bulge 3012 is aligned with the second receiving recess 3022. That is, the pushing bulge 3012 is disposed over the second receiving recess 3022 of the second frame 302. At the same time, the rotating shaft 3011 is disposed over the first receiving recess 3021 (see FIG. 5B).

Then, in response to a downward depressing force exerted on the first frame 301, the first frame 301 is moved downwardly. Consequently, the pushing bulge 3012 of the first frame 301 is moved from the top surface 3024B of the marking structure 3024 to the second guiding surface 3024A of the marking structure 3024. Meanwhile, the third slant surface 3012A of the pushing bulge 3012 is contacted with the second guiding surface 3024A of the marking structure 3024. On the other hand, as the rotating shaft 3011 of the first frame 301 is moved, the first slant surface 3011A of the rotating shaft 3011 is contacted with the first guiding surface 3026 of the second frame 302, and the position-limiting bulge 3014 of the first frame 301 is disposed over the notch 3027, which is exposed to the top surface 3025 of the second frame 302.

As the first frame 301 is continuously depressed and moved downwardly, the second guiding surface 3024A of the marking structure 3024 is pushed by the third slant surface 3012A of the pushing bulge 3012. Since the second frame 302 is pushed by the pushing bulge 3012, the second frame 302 is subject to deformation. That is, the second sidewall 3023 of the second frame 302 is propped open by the pushing bulge 3012. Consequently, a gap between the pushing bulge 3012 and the second guiding surface 3024A is created, and the pushing bulge 3012 is guided by the second guiding surface 3024A to pass through the second sidewall 3023. Moreover, since the first guiding surface 3026 is pushed by the first slant surface 3011A of the rotating shaft 3011, the first slant surface 3011A of the rotating shaft 3011 is guided by the first guiding surface 3026 to pass through the top surface 3025 of the second frame 302 and the second sidewall 3023. In such way, the rotating shaft 3011 will be introduced into the first receiving recess 3021. Similarly, as the second frame 302 is pushed by the pushing bulge 3012, the position-limiting bulge 3014 is introduced into the notch 3027 and transported across the stopping part 3027A of the notch 3027. In such way, the position-limiting bulge 3014 is accommodated within the notch 3027, and the position-limiting bulge 3014 is movable within the notch 3027.

Figure 6:
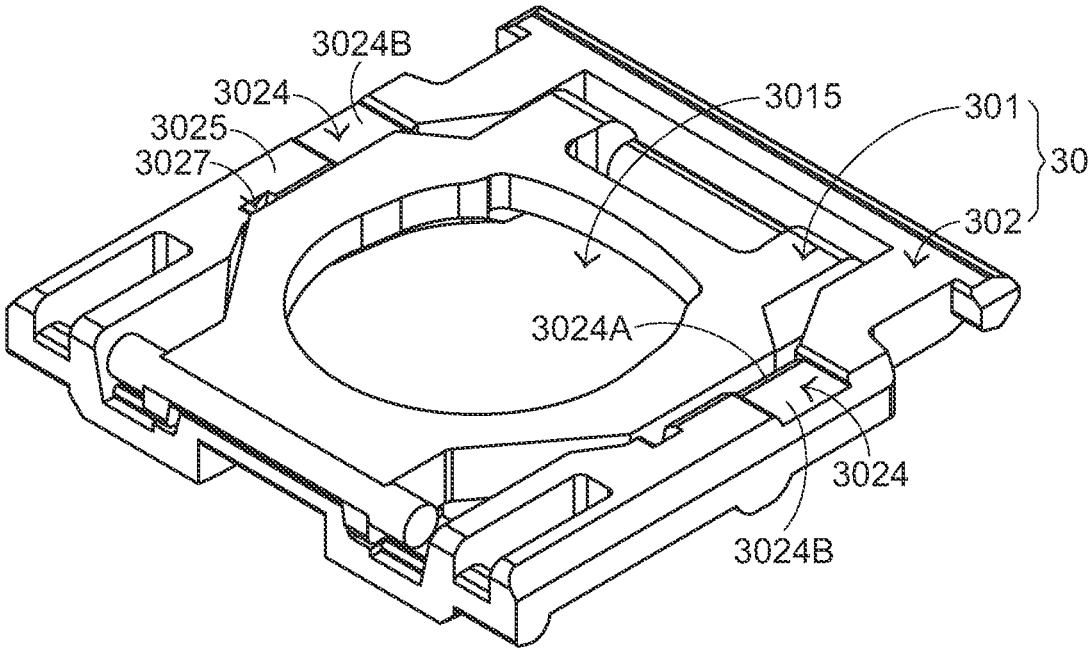
FIG. 6 is a schematic assembled view illustrating a combination of the first frame and the second frame of the key structure according to the first embodiment of the present invention.

As the first frame 301 is moved downwardly, the pushing bulge 3012 is transported across the second sidewall 3023 and introduced into the second receiving recess 3022, and accommodated within the second receiving recess 3022. On the other hand, the first slant surface 3011A of the rotating shaft 3011 (i.e. the half-lower portion of the rotating shaft 3011) is introduced into the first receiving recess 3021. Meanwhile, the second slant surface 3011B of the rotating shaft 3011 is contacted with the first receiving recess 3021 and sustained against the first receiving recess 3021 so as to facilitate the rotating shaft 3011 to be completely introduced into the first receiving recess 3021 and accommodated within the first receiving recess 3021. After the rotating shaft 3011 and the pushing bulge 3012 are respectively accommodated within the first receiving recess 3021 and the second receiving recess 3022, the second frame 302 is no longer pushed by the rotating shaft 3011 and the pushing bulge 3012, so that the second frame 302 is no longer subject to deformation but restored to the original shape. Under this circumstance, the first frame 301 and the second frame 302 are combined together. The combination of the first frame 301 and the second frame 302 is illustrated in FIG. 6. As shown in FIG. 6, the first frame 301 is installed inside the second frame 302, and the second frame 301 can be swung with respect to the first frame 301. Due to the structures of the position-limiting bulge 3014 and the notch 3027, the swinging extent of the second frame 302 is limited. In such way, since the second frame 302 is not excessively swung, the second frame 302 is not detached from the first frame 301.

Please refer to FIG. 3 again. When the keycap 32 of the key structure 3 with the scissors-type connecting member 30 is depressed, the second frame 302 of the scissors-type connecting member 30 is swung with respect to the first frame 301. In addition, the position-limiting bulge 3014 is moved within the notch 3027, and the pushing bulge 3012 is accommodated within the second receiving recess 3022. Under this circumstance, the scissors-type connecting member 30 is switched from an open-scissors state to a folded state. Moreover, in response to the depressing force, the keycap 32 is moved downwardly to push against the elastic element 34, and thus the membrane switch circuit 33 is triggered by the elastic element 34 to generate a key signal. Whereas, when the depressing force exerted on the keycap 32 is eliminated, an elastic force provided by the elastic element 34 is acted on the keycap 32. Due to the elastic force, the second frame 302 is swung with respect to the first frame 301 and the keycap 32 is returned to its original location where the keycap 32 has not been depressed. The operations of the key structure 3 with the scissors-type connecting member 30 have been described above.

Figure 7:
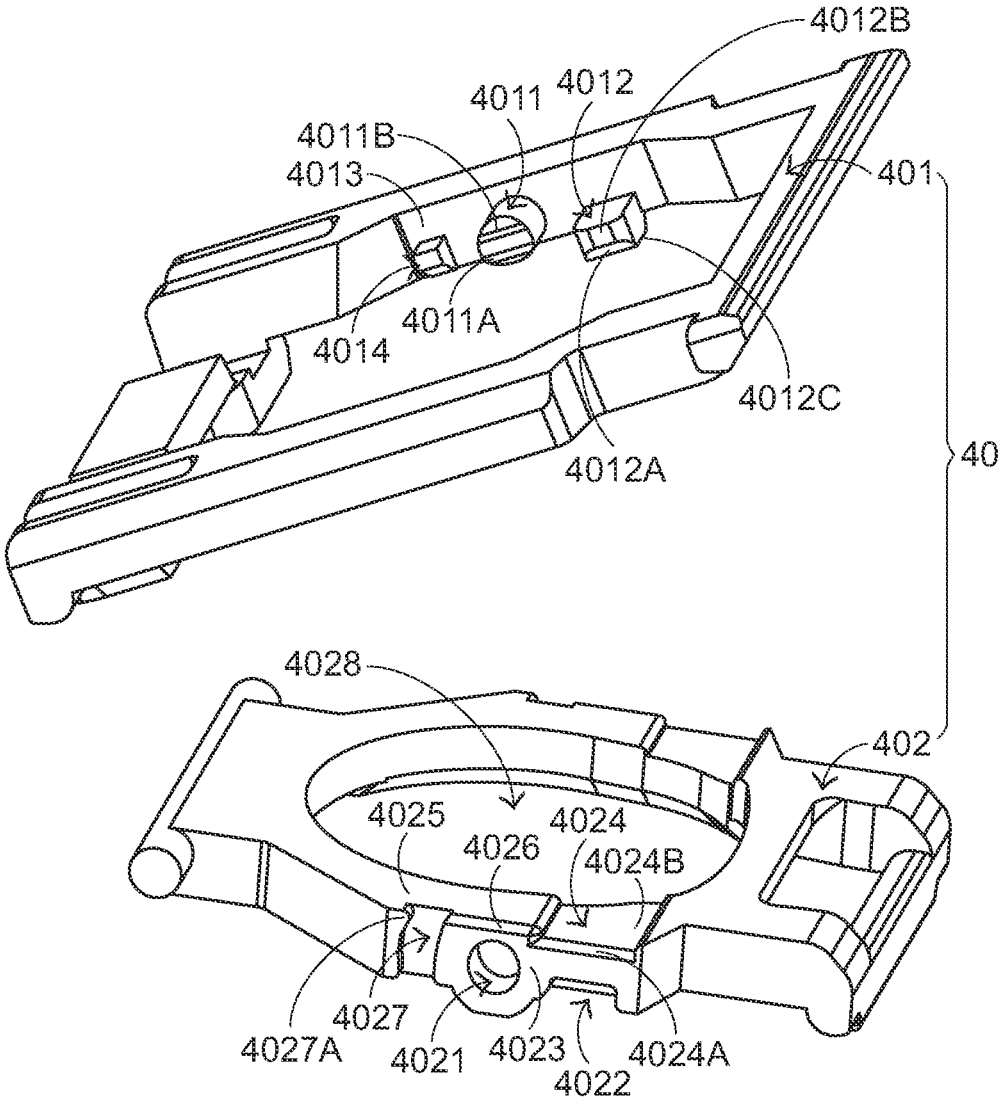
FIG. 7 is a schematic side view illustrating the first frame and the second frame of the scissors-type connecting member of the key structure according to a second embodiment of the present invention.

The present invention further provides a second embodiment of a key structure with a scissors-type connecting member. The base plate, the keycap, the membrane switch circuit and the elastic element included in the key structure of the second embodiment are similar to those of the first embodiment, and are not redundantly described herein. Hereinafter, the scissors-type connecting member 40 of the key structure according to the second embodiment of the present invention will be illustrated with reference to FIG. 7. FIG. 7 is a schematic side view illustrating the first frame and the second frame of the scissors-type connecting member of the key structure according to a second embodiment of the present invention. The scissors-type connecting member 40 comprises a first frame 401 and a second frame 402. The first frame 401 and the second frame 402 are connected with each other. The first frame 401 of the scissors-type connecting member 40 comprises a rotating shaft 4011, a pushing bulge 4012 and a position-limiting bulge 4014. The second frame 402 of the scissors-type connecting member 40 comprises a first receiving recess 4021, a second receiving recess 4022, a marking structure 4024, a first guiding surface 4026, a notch 4027 and a central hollow portion 4028.

In the first frame 401, the rotating shaft 4011 is disposed on a first sidewall 4013 of the first frame 401. Moreover, the rotating shaft 4011 has a first slant surface 4011A and a second slant surface 4011B. The pushing bulge 4012 is disposed on the first sidewall 4013 of the first frame 401 and arranged at a first side of the rotating shaft 4011. The location of the pushing bulge 4012 is lower than the location of the rotating shaft 4011. The pushing bulge 4012 comprises a third slant surface 4012A. The third slant surface 4012A is arranged between a sidewall 4012B of the pushing bulge 4012 and a bottom surface 4012C of the pushing bulge 4012. The position-limiting bulge 4014 is disposed on the first sidewall 4013 of the first frame 401 and arranged at a second side of the rotating shaft 4011.

In the second frame 402, the first receiving recess 4021 is formed in a second sidewall 4023 of the second frame 402 for accommodating the rotating shaft 4011. The second receiving recess 4022 is formed in the second sidewall 4023 of the second frame 402 and arranged at a first side of the first receiving recess 4021 for accommodating the pushing bulge 4012. The marking structure 4024 is disposed over the second receiving recess 4022 and exposed to a top surface 4025 of the second frame 402 for marking the location of the second receiving recess 4022. The marking structure 4024 further comprises a second guiding surface 4024A. The second guiding surface 4024A is arranged between a top surface 4024B of the marking structure 4024 and the second sidewall 4023. The first guiding surface 4026 is disposed over the first receiving recess 4021 and arranged between the top surface 4025 of the second frame 402 and the second sidewall 4023. The notch 4027 is formed in the second sidewall 4023 and exposed to the top surface 4025 of the second frame 402. Moreover, the notch 4027 is arranged at a second side of the first receiving recess 4021 for accommodating the position-limiting bulge 4014. The position-limiting bulge 4014 is movable within the notch 4027. The notch 4027 has a stopping part 4027A for stopping the position-limiting bulge 4014 and limiting the movable range of the position-limiting bulge 4014 within the notch 4027. Except that the first frame 401 is an outer frame and the second frame 402 is an inner frame, the configurations and functions of the scissors-type connecting member 40 are similar to those of the first embodiment. That is, the second frame 402 is installed within the first frame 401. The process of assembling the first frame 401 with the second frame 402 is similar to that of the first embodiment, and is not redundantly described herein.

In the scissors-type connecting member of the key structure according to the above two embodiments, the pushing bulge is arranged beside the rotating shaft and the location of the pushing bulge is at a level lower than the rotating shaft. Consequently, when the first frame is stacked on the second frame, the pushing bulge is contacted with the second frame at first. The key structure is helpful to simplify the process of combining the first frame with the second frame. For assembling the scissors-type connecting member, the first frame is firstly stacked on the second frame. Then, by pressing down the first frame, the pushing bulge will push against the second frame, and thus the second frame is subject to deformation to facilitate introducing the rotating shaft and the pushing bulge into the first receiving recess and the second receiving recess of the second frame, respectively. Since the user needs not to prop open the outer frame and have the inner frame shafts insert into corresponding outer frame holes during the process of assembling the scissors-type connecting member, the problems of assembling the conventional scissors-type connecting member will be eliminated. Moreover, since the use of the key structure of the present invention can simplify the process of combining the first frame with the second frame, the scissors-type connecting member can be automatically assembled and the assembling efficiency will be enhanced. Moreover, since the hole structure of the outer frame hole of the conventional key structure is replaced by the recess structure of the first receiving recess of the second frame according to the present invention, the possibility of damaging the second frame because of the hole structure will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure with a scissors-type connecting member, said key structure comprising:

a base plate;

a keycap; and said scissors-type connecting member arranged between said base plate and said keycap for connecting said base plate with said keycap, so that said keycap is moved upwardly or upwardly with respect to said base plate, wherein said scissors-type connecting member comprises:

a first frame comprising a rotating shaft and a pushing bulge, wherein said rotating shaft is disposed on a first sidewall of said first frame, wherein said pushing bulge is disposed on said first sidewall of said first frame and arranged at a first side of said rotating shaft, and said pushing bulge is located at a level lower than said rotating shaft, wherein said first frame further comprises a position-limiting bulge, which is disposed on said first sidewall of said first frame and arranged at a second side of said rotating shaft; and a second frame connected with said first frame and permitted to be swung with respect to said first frame, and comprising a first receiving recess and a second receiving recess, wherein said first receiving recess is formed in a second sidewall of said second frame for accommodating said rotating shaft, wherein said second receiving recess is formed in said second sidewall of said second frame and arranged at a first side of said first receiving recess for accommodating said pushing bulge.

2. The key structure according to claim 1 wherein said second frame further comprises:

a marking structure disposed over said second receiving recess and exposed to a top surface of said second frame for marking a location of said second receiving recess; and a first guiding surface disposed over said first receiving recess and arranged between said top surface of said second frame and said second sidewall, wherein after said first frame is stacked on said second frame and said pushing bulge is contacted with said top surface of said second frame, said rotating shaft is guided by said first guiding surface to pass through said top surface of said second frame and said second sidewall so as to be accommodated within said first receiving recess.

3. The key structure according to claim 2 wherein said rotating shaft comprises:

a first slant surface, when said second sidewall of said second frame is pushed by the pushing bulge, said first guiding surface is contacted with and pushed by said first slant surface, so that said rotating shaft is guided to be introduced into said first receiving recess; and a second slant surface disposed over said first slant surface to be contacted with said first receiving recess, thereby facilitating said rotating shaft to be introduced into said first receiving recess.

4. The key structure according to claim 2 wherein said marking structure further comprises a second guiding surface, which is arranged between a top surface of said marking structure and said second sidewall, wherein after said first frame is stacked on said second frame and said pushing bulge is contacted with said marking structure, said pushing bulge is guided by said second guiding surface to pass through said marking structure and said second sidewall so as to be accommodated within said second receiving recess.

5. The key structure according to claim 4 wherein said pushing bulge comprises a third slant surface, which is arranged between a sidewall of said pushing bulge and a bottom surface of said pushing bulge, wherein when said second guiding surface is contacted with and pushed by said third slant surface, said second frame is subject to deformation to facilitate introducing said rotating shaft and said pushing bulge into said first receiving recess and said second receiving recess, respectively.

6. The key structure according to claim 1 wherein said second frame further comprises a notch, which is formed in said second sidewall of said second frame, exposed to a top surface of said second frame and arranged at a second side of said first receiving recess, wherein said position-limiting bulge is movable within said notch, wherein said notch has a stopping part for stopping said position-limiting bulge and limiting a movable range of said position-limiting bulge within said notch.

7. The key structure according to claim 1 further comprising:

a membrane switch circuit disposed on said base plate, wherein when said membrane switch circuit is triggered, said membrane switch circuit generates a key signal; and an elastic element disposed on said membrane switch circuit, wherein a lower portion of said elastic element is contacted with said membrane switch circuit, wherein said elastic element is penetrated through said scissors-type connecting member and an upper portion of said elastic element is contacted with said keycap, wherein when said elastic element is pushed by said keycap, said membrane switch circuit is triggered by said elastic element, wherein when a depressing force exerted on said keycap is eliminated, an elastic force provided by said elastic element is exerted on said keycap.

8. The key structure according to claim 1 wherein said first frame is an inner frame, said second frame is an outer frame, said first frame is installed within said second frame, and said first frame has a central hollow portion.

9. The key structure according to claim 1 wherein said first frame is an outer frame, said second frame is an inner frame, said second frame is installed within said first frame, and said second frame has a central hollow portion.

* * * * *